US010320078B2

(12) United States Patent
Bringuier et al.

(10) Patent No.: US 10,320,078 B2
(45) Date of Patent: Jun. 11, 2019

(54) SMALL FORM FACTOR CPL ANTENNA WITH BALANCED FED DIPOLE ELECTRIC FIELD RADIATOR

(71) Applicant: DOCKON AG, Zurich (CH)

(72) Inventors: Jonathan Neil Bringuier, Carlsbad, CA (US); Ryan James Orsi, San Diego, CA (US); Forrest James Brown, San Diego, CA (US)

(73) Assignee: QuantalRF AG

( * ) Notice: Subject to any disclaimer, the term of this patent is extended or adjusted under 35 U.S.C. 154(b) by 371 days.

(21) Appl. No.: 15/355,815

(22) Filed: Nov. 18, 2016

(65) Prior Publication Data

US 2018/0145409 A1 May 24, 2018

(51) Int. Cl.

| | |
|---|---|
| ***H01Q 7/00*** | (2006.01) |
| ***H01Q 9/06*** | (2006.01) |
| ***H01Q 9/26*** | (2006.01) |
| ***H01Q 9/42*** | (2006.01) |
| ***H01Q 21/30*** | (2006.01) |

(52) U.S. Cl.

CPC ..... *H01Q 7/00* (2013.01); *H01Q 9/065* (2013.01); *H01Q 9/26* (2013.01); *H01Q 9/42* (2013.01); *H01Q 21/30* (2013.01)

(58) Field of Classification Search

CPC ..... H01Q 7/00; H01Q 9/065; H01Q 9/26; H01Q 9/265; H01Q 21/30

See application file for complete search history.

(56) References Cited

U.S. PATENT DOCUMENTS

| | | | |
|---|---|---|---|
| 7,782,257 | B2 | 8/2010 | Kim et al. |
| 8,149,173 | B2 | 4/2012 | Brown |
| 2011/0018777 | A1 | 1/2011 | Brown |
| 2013/0057440 | A1 | 3/2013 | Brown et al. |
| 2013/0201074 | A1 | 8/2013 | Harper et al. |
| 2015/0162660 | A1 | 6/2015 | Orsi et al. |

OTHER PUBLICATIONS

Lu et al.; "Dual-Band Loop-Diople Composite Unidirectional Antenna for Broadband Wireless Communications"; IEEE Transactions on Antennas and Propagation; vol. 62 No. 5; May 2014; p. 2860-2866.

International Search Report and Written Opinion dated Jan. 30, 2018 for PCT Application No. PCT/US2017/061411, 7 pages.

*Primary Examiner* — Robert Karacsony

(74) *Attorney, Agent, or Firm* — Cooley LLP

(57) ABSTRACT

An antenna is disclosed with a magnetic loop, a dipole electric field radiator inside the magnetic loop, and with symmetric geometry about the feed. This symmetry allows for realization of image theory and significant size reduction, whereby half of the antenna is removed and replaced by the image induced in a connected ground plane.

19 Claims, 3 Drawing Sheets

SMALL FORM FACTOR CPL ANTENNA WITH BALANCED FED DIPOLE ELECTRIC FIELD RADIATOR

TECHNICAL FIELD

This disclosure relates to antennas for electromagnetic communication.

BACKGROUND

As form factor of many modern telecommunications devices shrinks, the design constraints for size of antennas increases. Mobile battery-powered devices in particular require both small size and energy efficiency. Antennas affect both the size and efficiency of these devices. In addition to size and power or radiation efficiency, other design goals for communication antennas may include directionality, higher bandwidth (lower Q), and manufacturing cost.

Two-dimensional microstrip antennas are attractive for modern devices for both their small size and low cost for manufacturing. Dimensions of two-dimensional antennas are often close to a quarter wavelength, and hence small, and they may consist simply of printed stripes of metal on an ordinary circuit board, though other materials and manufacturing methods are possible such as Teflon or alumina substrate.

A more efficient transmitting antenna will convert a larger portion of the energy fed to it into electromagnetic radiation, while a more efficient receiving antenna will convert a larger portion of received electromagnetic radiation into an electrical signal for processing by receiving electronics.

Simple loop antennas are typically current fed devices, which produce primarily a magnetic (H) field. As such, they are not typically suitable as transmitters. This is especially true of small loop antennas with an electrical length of less than one wavelength at the target frequency of usage. In contrast, voltage fed antennas, such as dipoles, produce both electric (E) fields and H-fields and can be used in both transmit and receive modes.

The amount of energy received by, or transmitted from, a loop antenna is, in part, determined by its area. Typically, each time the area of the loop is halved, the amount of energy which may be received/transmitted is reduced by approximately 3 dB depending on application parameters, such as initial size, frequency, etc. This physical constraint tends to mean that very small loop antennas cannot be used in practice.

Electrically short (ELS) antennas, as defined by H. A. Wheeler, are antennas with dimension very small as compared to the wavelength radiated from or received by them. The size of ELS antennas are attractive for small form-factor devices. However, ELS antennas suffer from large radiation quality factors, Q, in that they store, on average, more energy than they radiate. Such high Q results in a small resistive loss in an antenna or matching network and leads to very low radiation efficiencies, typically 1-50%, and narrow bandwidths.

Compound field antennas are those in which both the transverse magnetic (TM) and transverse electric (TE) modes are excited. In contrast to both simple loop antennas and ELS antennas, compound field antennas can achieve higher performance benefits such as higher bandwidth (lower Q), greater radiation intensity/power/gain, and greater efficiency. Designing a compound field antenna has often proven difficult due to the unwanted effects of element coupling and the related difficulty in designing a low loss passive network to combine the electric and magnetic radiators.

The basis for the increased performance of compound field antennas, in terms of bandwidth, efficiency, gain, and radiation intensity, derives from the effects of energy stored in the near field of an antenna. In RF antenna design, it is desirable to transfer as much of the energy presented to the antenna into radiated power as possible. The energy stored in the antenna's near field has historically been referred to as reactive power and serves to limit the amount of power that can be radiated. Complex power refers to separate real and imaginary components of power, where the imaginary component is often referred to as the "reactive" portion. Real power leaves the source and never returns, whereas the imaginary or reactive power tends to oscillate about a fixed position (within a half wavelength) of the source and interacts with the source, thereby affecting the antenna's operation. The presence of real power from multiple sources is directly additive, whereas multiple sources of imaginary power can be additive or subtractive (canceling). The benefit of a compound antenna is that it is driven by both TM (electric dipole) and TE (magnetic dipole) sources at the same frequency which allow engineers to create designs utilizing reactive power cancellation that was previously not available in simple field antennas, thereby improving the real power transmission properties of the antenna.

In order to cancel reactive power in a compound antenna, it is necessary for the electric far field zone and the magnetic far field zone to operate orthogonal to each other. While numerous arrangements of the electric field radiator(s), necessary for emitting the electric field, and the magnetic loop, necessary for generating the magnetic field, have been proposed, all such designs have invariably settled upon a three-dimensional antenna until U.S. Pat. No. 8,149,173 introduced a compound loop (CPL) antenna in planar configurations, that operated with compound antenna efficiency provided the electric filed radiator was connected to the magnetic loop at a 90 or 270 degree phase difference location on the magnetic loop.

While the concept of image theory makes it possible to reduce the size of the artwork for an antenna by half, if the antenna is completely symmetrical, by replacing half of the antenna with a ground plane, it has not been possible to implement image theory with a CPL antenna because the 90 or 270 degree location requirement resulted in electric filed radiator being placed in a position where a symmetrical design was not possible. And, while certain antennas may look the same as a symmetrical CPL antenna, such as an antenna illustrated and described in "Dual-Band Loop-Dipole Composite Unidirectional Antenna for Broadband Wireless Communications," Wen-Jun Lu, et al, in IEEE Transactions on Antennas and Propagation, vol. 62, no. 5, pp. 2860-2866, May 2014, the dipole located inside the loop of the antenna operates at a different frequency than the magnetic loop and therefore cannot be a CPL antenna.

SUMMARY

This disclosure includes both a symmetric compound loop (CPL) antenna and a half-sized version with half of the symmetric antenna replaced with a ground plane. The symmetric antenna comprises: a magnetic loop, with a break at the feed point creating a first end and a second end, configured for a feed attached to the first end and second end, and with an electrical length; a dipole antenna inside the magnetic loop, with a first arm and a second arm, wherein the electrical length of the first arm and the electrical length of the second arm is approximately one-quarter of the electrical length of the magnetic loop; a first electrical link between the first arm and the first end, where the electrical length of the first electrical link is approximately one-quarter of the electrical length of the magnetic loop; a second electrical link between the second arm and the magnetic loop, where the electrical length of the second electrical link is approximately one-quarter of the electrical length of the magnetic loop; and wherein the antenna is symmetric about an axis that passes through the break between the first end and the second end.

A half sized CPL antenna is also disclosed, comprising: a magnetic loop half, comprising a first end and a second end, configured for a feed point at the first end, and wherein a half loop length is the electrical length of the magnetic loop half; a dipole half, comprising a first arm but not comprising a second arm; a first electrical link between the magnetic loop half and the dipole half a ground plane, with a straight edge, and connected to the second end of the magnetic loop half along the straight edge of the ground plane; and wherein the ground plane is sufficiently large to effective create a mirror image of the magnetic loop half, the dipole half, and the first electrical link such that effect of the signal radiated from the antenna and the reflection in the ground plane is similar in operation to a symmetric antenna comprising the magnetic loop half, the dipole half, the first electrical link, and the mirror image of those antenna elements where the mirror image is reflected about an axis of symmetry along the straight edge of the ground plane.

Variations include the above antenna wherein the electrical length of the first arm is approximately one-half of the half loop length. Another variation includes the above antenna wherein the length of the first electrical link is approximately one-half of the half loop length. A further variation includes the above antenna wherein the first arm has an inner end and an outer end, wherein the inner end is positioned closer to the ground plane, and the first electrical link connects the inner end of the first arm to the first end of the magnetic loop half. A final variation includes the above antenna wherein the first electrical link has an electrical length of approximately one-half of the half loop length.

BRIEF DESCRIPTION OF THE DRAWINGS

A more detailed understanding may be had from the following description, given by way of example in conjunction with the accompanying drawings wherein.

DETAILED DESCRIPTION OF ILLUSTRATIVE EMBODIMENTS

Figure 1:
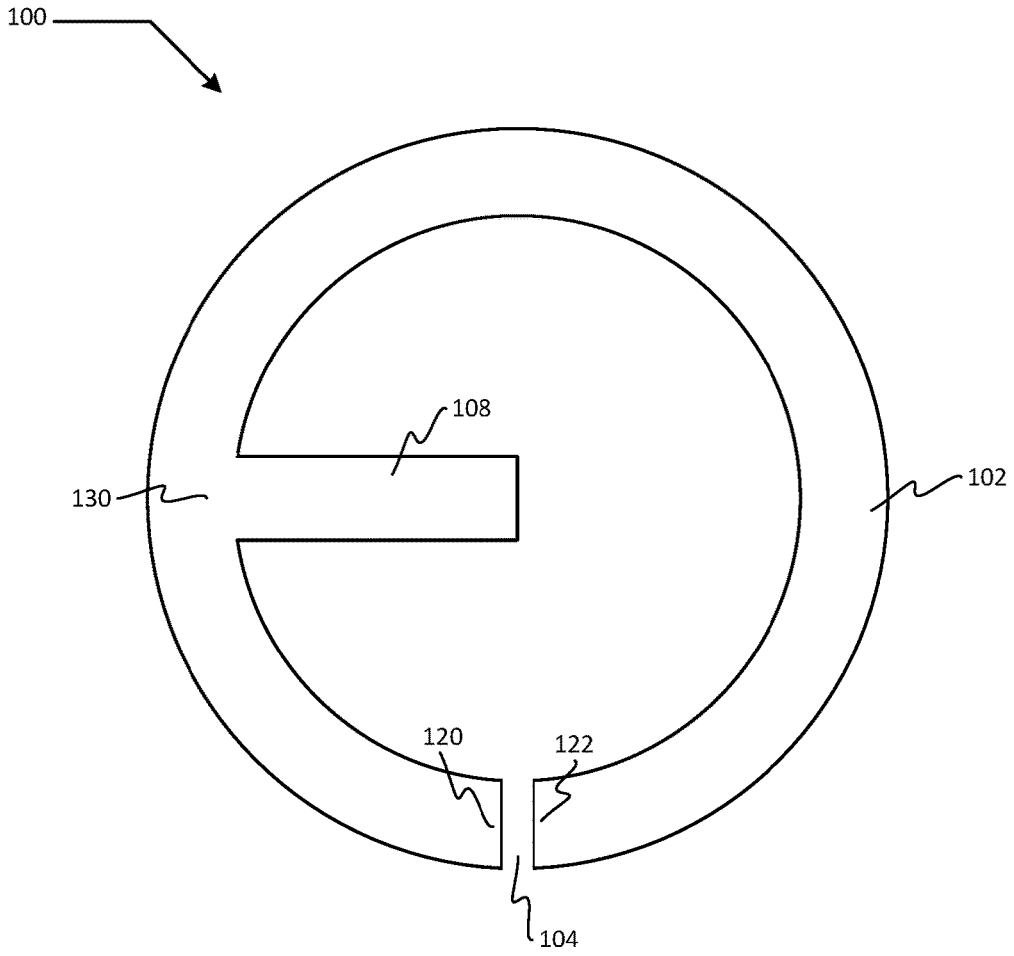
FIG. 1 (Prior Art)
FIG. 1 depicts an illustrative prior art compact loop antenna (CPL antenna).

This disclosure presents a compound loop (CPL) antenna with an outer magnetic loop antenna and an inner electric dipole radiator antenna. The design is symmetric, enabling variations that replace half of the compound loop antenna with a reflective ground plane using antenna image theory. The result is a smaller antenna, half the size, aside from the ground plane, of other such CPL antennas. The CPL antenna can be constructed as a microstrip or printed antenna.

The primary elements of a CPL antenna as disclosed herein are a magnetic field antenna and an electric field antenna. Embodiments include a loop antenna producing or receiving primarily a magnetic field (H-field) with a dipole antenna inside or outside the loop for producing or receiving primarily an electric field (E-field). The loop can be any substantially two-dimensional closed path with a small break at one point in the path, where the antenna is fed at one end and grounded at the other. The electric field antenna can be any electric field antenna positioned inside or outside the loop, and should be electrically connected to the loop at one or more 90 or 270 degree points around the loop.

A compound loop antenna is particularly efficient compound field antenna where the H-field antenna portion, the loop, and the E-field antenna portion, the radiator, are arranged such that the far field zones of the H-field and the E-field are orthogonal to each other. Such an orthogonal relationship occurs when the phase relationship between the H-field and the E-field is at either 90 or 270 degrees apart. The phase relationship need not be exactly 90 or 270 degrees, but the closer to 90 or 270 degrees the relationship is, the more efficient the antenna may be. An orthogonal relationship is also possible when the radiator is connected to the loop at a minimum surface current reflection point along the loop, which may be close to or approximately at 90 or 270 degrees, but not exactly 90 or 270 degrees.

One way to create such as phase relationship is to feed the radiator from the loop (e.g., connect the radiator to the loop) at a location one-quarter of a wavelength (90 degrees) of the way around the radiator from the signal feed point on the loop. A signal wave entering the radiator at the feed point will then have to travel along the electrical length (or phase length) of the loop before reaching the radiator, and hence the phase of the E-field will be shifted relative to the H-field by an amount determined by the time delay between a signal entering the H-field feed point and the same signal later entering the E-field feed point.

In an alternate example to create such a phase delay is to vary the length of connection between the loop and the radiator. A radiator located some distance from the loop will be electrically connected to loop, and that connection will have an electrical length that also introduces a phase delay between the connection location on the loop and the radiator. By varying the electrical length of the connection between the radiator and the loop will vary the phase shift between signals generated by the radiator and the loop. Also, a combination of connection length and connection location on the loop can be used to vary the phase relationship between the loop and the radiator.

A magnetic loop may be any of a number of different electrical and physical lengths; however, electrical lengths that are multiples of a wavelength, a quarter wavelength, and an eighth wavelength, (or other power-of-two fraction of a wavelength) in relation to the desired frequency band(s), provide for a more efficient operation of the antenna. However, adding inductance to the magnetic loop increases the electrical length of the magnetic loop. Adding capacitance to the magnetic loop has the opposite effect, decreasing the electrical length of the magnetic loop.

Efficient CPL designs include a wide variety of shapes of magnetic loops and wide variety of types of radiators. Some embodiments disclosed herein include an E-field radiator inside the H-field loop, where the combination of E-field radiators and H-field loops are symmetric about an axis. Example embodiments include a loop that is rounded, including circular, and a radiator that is a dipole. A symmetric CPL antenna design enables use of antenna image theory by replacing half of the CPL on one side of the axis of symmetry with a ground plane. This results in a CPL of half the size, but with substantially similar antenna characteristics as the full size CPL antenna.

Microstrip or printed circuit antenna techniques are well known and are not discussed in detail here. It is sufficient to say that copper traces are arranged and printed (normally via etching or laser trimming) on a suitable substrate having a particular dielectric effect. By careful selection of materials and dimensions, particular values of capacitance and inductance can be achieved without the need for separate discrete components.

Some present embodiments can be arranged and manufactured using known microstrip techniques where the final design is arrived at as a result of a certain amount of manual calibration whereby the physical traces on the substrate are adjusted. In practice, calibrated capacitance sticks are used which comprise metallic elements having known capacitance elements, e.g., 2 picoFarads. A capacitance stick, for example, may be placed in contact with various portions of the antenna trace while the performance of the antenna is measured.

To a person skilled in the art, this technique reveals where the traces making up the antenna should be adjusted in size, equivalent to adjusting the capacitance and/or inductance. After a number of iterations, an antenna having the desired performance can be achieved.

Once the approximate connection location between the E-field and the H-field has been determined, bearing in mind that at the intended operating frequency band, the slightest interference from test equipment can have a large practical effect, fine adjustments can be made to the connection and/or the values of inductance (L) and capacitance (C) by laser trimming the traces in-situ. Once a final design is established, it can be reproduced with good repeatability. Alternatively, the point of connection and the loop can be determined using an electromagnetic software simulation program to visualize surface currents, and choosing possible areas for a connection base on surface current magnitude.

FIG. 1 depicts an illustrative prior art compound loop antenna (CPL antenna). Antenna 100 comprises a magnetic loop 102, which is substantially circular, with a break at 104. The break 104 may denote the feed point 120, for example, with one lead attached to the magnetic loop on a first side of break 104 at feed point 120, and the other lead attached to a second side of break 104 at ground point 122. The two ends of the magnetic loop 102 should not be conductive across the break 104. The connection point 130 between monopole electric radiator 108 and magnetic loop 102 is the feed point for monopole 108. As depicted, the connection point 130 is approximately 90 or 270 degrees electrically around the loop from the feed point 120, but as described above, the important design constraint for radiation efficiency is actually that the electrical distance between feed point 120 and connection point 130 be either 90 or 270 degrees or a reflective current minimum point. In this prior art design, the electrical length of monopole 108 is approximately one-half the wavelength of the target frequency. The target frequency is the operating frequency for the monopole, and may also be the operating frequency of the magnetic loop 102.

Figure 2:
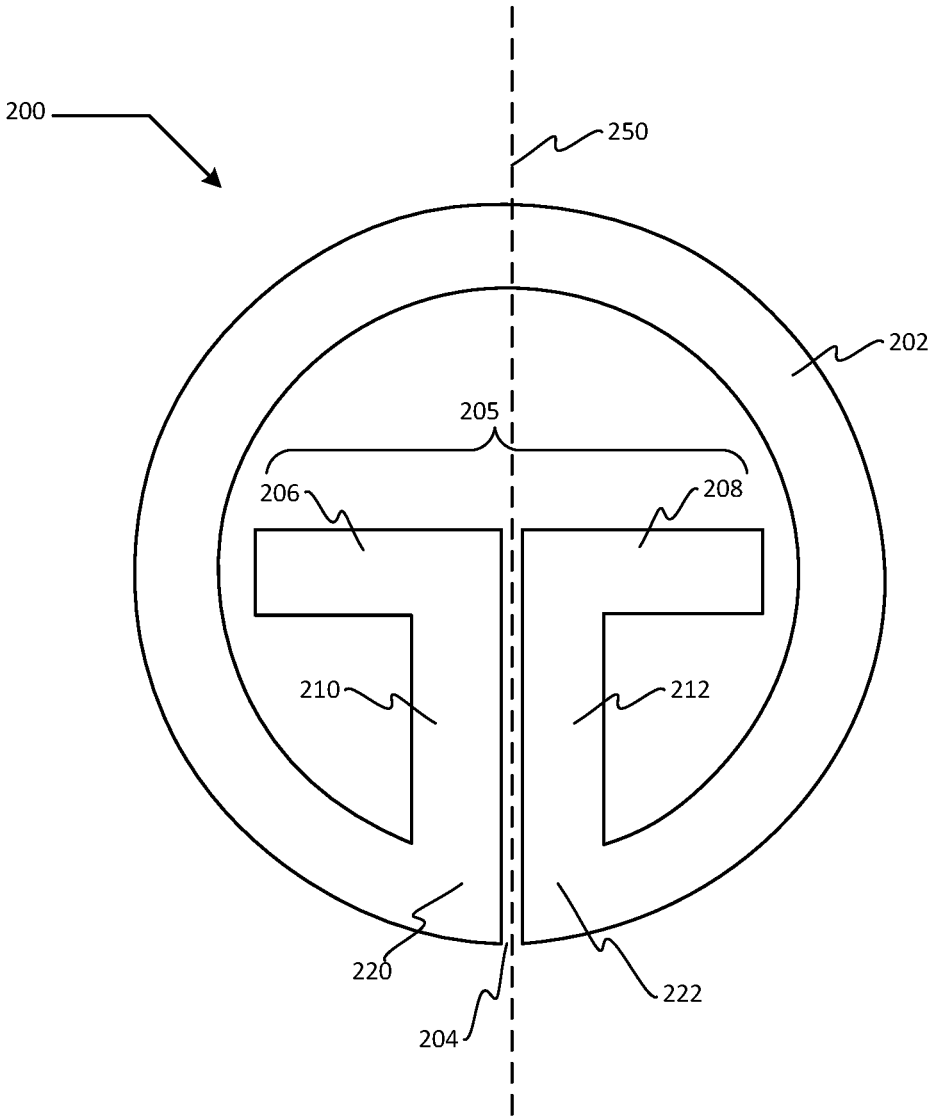
FIG. 2 depicts an illustrative symmetric compact loop antenna with dipole inside a rounded loop antenna.

FIG. 2 depicts an illustrative CPL antenna with a balanced fed dipole electric field radiator positioned inside a rounded loop antenna. This antenna 200 comprises an outer loop 202, with a dipole 205 inside the loop 202. As in FIG. 1, loop 202 has a break or opening at 204. The dipole 205 is comprised of two co-linear arms 206, 208, located roughly in the center of the loop 202, and connected to the loop 202 by extensions 210, 212, respectively. Left arm 206 is connected to loop 202 by left extension 210 at feed point 220, and right arm 208 is connected by right extension 212 at feed point 222. Either feed point 220, or feed point 222, or both feed points 220 and 222 may be supplied power from an outside source, such as a coaxial cable. The overall result is a design that is symmetric about axis 250. The length of each dipole arm is approximately one-quarter of the wavelength of the dipole target frequency, which may be a frequency expected to be used in the loop 202, or a power-of-two fraction of a frequency expected to be used in the loop 202. The connection points for the extensions 210, 212 on the loop 202 in FIG. 2 are directly at the feed points 220 and 222, but result in the arms 206, 208 still being located at 90 or 270 degree electrical length locations due to phase delay imparted by the extensions 210, 212 Since the loop 202 and dipole 205 operate at the same frequency, and the dipole 205 is positioned at 90 or 270 degree points relative to the loop 202, the H-field and E-field will be orthogonal and the antenna will operate as a CPL antenna.

Embodiments can vary from the illustration of FIG. 2. The sizes of the main antenna elements (loop 202, arms 206 and 208, and extensions 210 and 212) may be substantially similar to each other, as depicted in FIG. 2, but may vary in other embodiments. Similarly, loop 202 may be circular as depicted in FIG. 2, but embodiments may also include any variety of magnetic loop shapes that enclose the dipole arms and that have an electrical length appropriate for the target frequency. Likewise, differently shaped or positioned dipoles may be used provided the 90 or 270 degree phase delay requirement is met.

Figure 3:
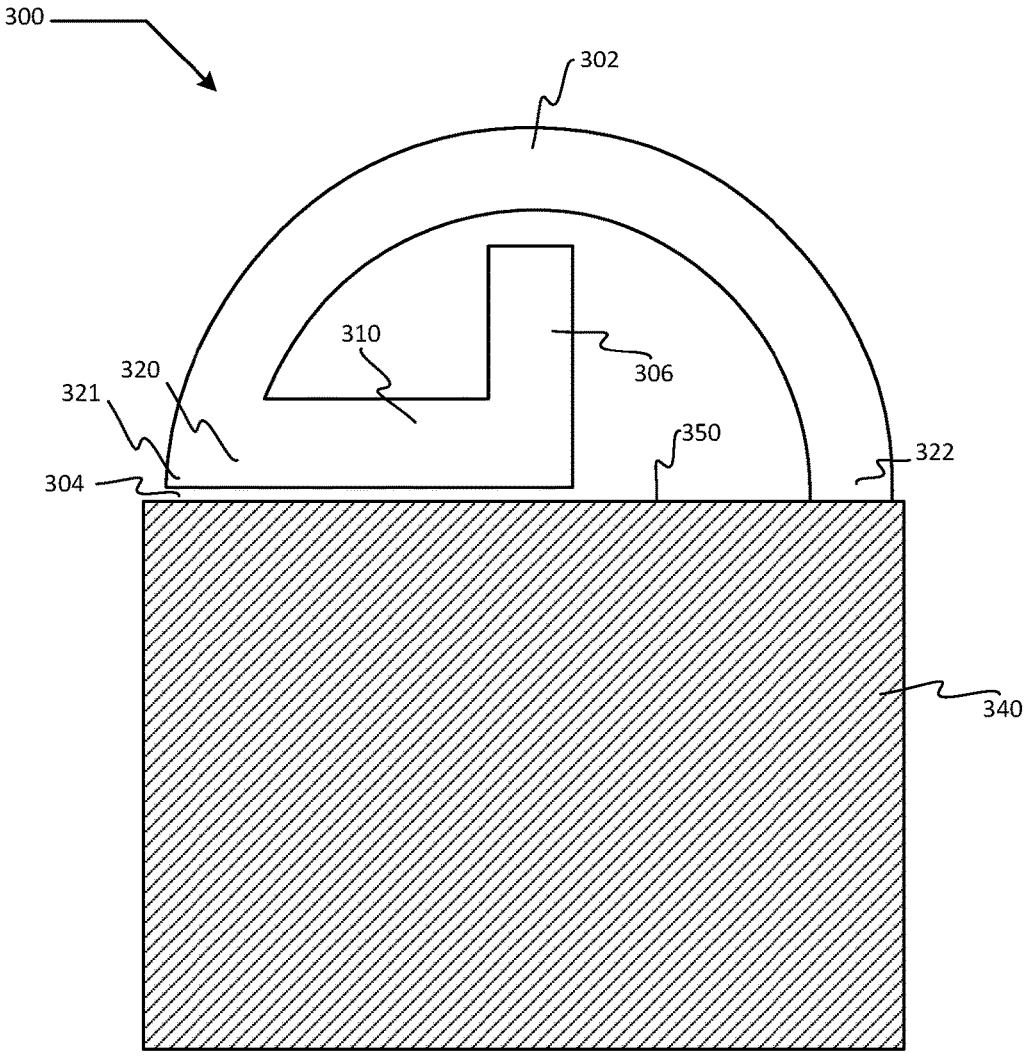
FIG. 3 depicts the illustrative antenna of FIG. 2, halved with a ground image plane.

FIG. 3 depicts the illustrative antenna of FIG. 2, halved, with a ground image plane replacing half of the antenna and thereby reducing the form factor of the antenna without reducing operational characteristics. Antenna 300 is similar to antenna 200 of FIG. 2, cut along axis 250, and where the portion of the antenna to the right half of the axis 250 has been replaced with ground plane structure 340, where edge 350 of ground plane structure 340 would be the location of the axis of symmetry. The ground plane structure 340 may be a printed micro-strip ground plane structure in the same plane of the antenna artwork or in a plane perpendicular to the plane of the antenna. Antenna image theory indicates that an infinite reflective ground plane will simulate an antenna that comprises the antenna above the ground plane with a reflection of that antenna below the ground plane. By replacing half of symmetric antenna 200 with a ground plane structure, an antenna will be created that is effectively identical in function, but with only one half of the physical area of antenna 200. While antenna image theory may proscribe an infinite ground plane located beneath the antenna, similar performance by antenna 300 can be approximated with a ground plane structure 340 that extends beyond the near-field zone of the antenna 300. In other words, the near-field zone of the antenna may extend a first distance from the dipole radiator and the ground plane structure may extend a second distance from the dipole radiator, such that the second distance is larger than the first distance. As the size of the ground plane structure 340 will depend on the performance characteristics of the antenna, wherein different sized ground plane structures may be required to determine the appropriate size of the ground plane structure for different antennas.

The semicircle loop 302 has an opening or break 304 between the ground plane 340 and a first end 321 of the loop at feed point 320, where external power is supplied. However, the opposite end of semicircle loop 302 at second end 322 is in electrical contact with ground plane 340, which may be either a perpendicular or parallel system ground. Only the left arm of antenna 200's dipole is retained as arm 306 in antenna 300, and arm 306 is connected to semicircle loop 302's feed point 320 via extension 310. The functional result of the antenna 300 with the reflection in the ground plane 340 is a complete magnetic loop surrounding a complete dipole, where semicircle loop 302 is a magnetic loop half, and arm 306 is a dipole half.

As in antenna 200, the length of arm 306 is approximately one quarter of the wavelength of the target frequency of semicircle loop 302. The length of extension 310 is also one quarter of the wavelength of the target frequency of semicircle loop 302 so the effective dipole radiator and effective loop radiator (including the effective reflection in the ground plane) have a quadrature phase relationship and retain the efficiency of a CPL antenna.

Embodiments can vary from the illustration of FIG. 3. The widths of the main antenna elements (loop half 302, arm 306, and extension 310) may be substantially the same or similar, as depicted in FIG. 3, but may vary in other embodiments. Similarly, loop half 302 may be in the shape of a semicircle, as depicted in FIG. 3, but embodiments may also include any variety of magnetic loop shapes that, along with the reflection in the ground plane of loop half 302, enclose the dipole arm 306, and that has an electrical length appropriate for the target frequency.

In an embodiment, a compound loop antenna comprises a magnetic loop structure having a first end and a second end formed by an opening between the first end and the second end, the first end being connected to a feed and the second end being connected to a ground, the magnetic loop structure having a loop length defined by an electrical length of the magnetic loop structure; a dipole positioned inside the magnetic loop structure, the dipole having a first arm and a second arm; a first electrical link between the first arm and the magnetic loop structure creating a 90 degree phase delay from the feed along the electrical length of the magnetic loop structure; and a second electrical link between the second arm and the magnetic loop structure creating a 270 degree phase delay from the feed along the electrical length of the magnetic loop structure; wherein the compound loop antenna is symmetric about an axis that passes through the opening between the first end and the second end.

In the embodiment, the first arm has a first electrical length and the second arm has a second electrical length and each of the first electrical length and the second electrical length is approximately one-quarter of the electrical length of the magnetic loop structure. In the embodiment the first electrical link has a first electrical length and the second electrical link has a second electrical length and each of the first electrical length and the second electrical length is approximately one-quarter of the electrical length of the magnetic loop structure.

In the embodiment, the first arm having a first inner end and a first outer end and the second arm having a second inner end and a second outer end, wherein the first inner end and the second inner end are positioned closer to a center point within the magnetic loop structure; the first electrical link connects the first inner end to the first end of the magnetic loop structure; and the second electrical link connects the second inner end to the second end of the magnetic loop structure. In the embodiment, the first electrical link has a first electrical length and the second electrical link has a second electrical length, each of the first electrical length and the second electrical length being approximately one-quarter of the electrical length the magnetic loop structure.

In the embodiment, the first electrical link has a first straight edge and the second electrical link has a second straight edge substantially parallel to the first straight edge, wherein the first straight edge and the second straight edge are substantially parallel the axis. In the embodiment, a width of the magnetic loop, a width of the first arm, a width of the second arm, a width of the first electrical link, and a width of the second electrical link are substantially the same. In the embodiment, the antenna is a microstrip antenna.

In an embodiment, a compound loop antenna comprises a half magnetic loop structure having a first end connected to a feed and a second end connected a ground plane structure, the half magnetic loop structure having a loop length defined by an electrical length of the half magnetic loop structure; a half dipole positioned inside the half magnetic loop structure, the dipole having an arm; an electrical link between the arm and the half magnetic loop structure creating a 90 degree phase delay from the feed along the electrical length of the half magnetic loop structure; and wherein the ground plane structure is configured to have a size that extends beyond a near-field zone of the compound loop antenna so as to create a reflective equivalent of the half magnetic loop structure, the half dipole, and the arm.

In the embodiment, an electrical length of the arm is approximately one-quarter of the electrical length of the half magnetic loop structure. In the embodiment, an electrical length of the electrical link is approximately one-quarter of the electrical length of the half magnetic loop structure.

In the embodiment, the arm has an inner end and an outer end, wherein the inner end is positioned closer to a center point between the first end and the second end of the half magnetic loop structure; and the electrical link connects the inner end of the arm to the first end of the half magnetic loop structure. In the embodiment, the electrical length of the electrical link is approximately one-quarter of the electrical length of the half magnetic loop structure. In the embodiment, the electrical link has a substantially straight edge between the inner end and the outer end of the arm, and wherein the substantially straight edge is substantially parallel to at least a portion of an end of the ground plane structure.

In the embodiment, a width of the magnetic loop, a width of the arm, and a width of the electrical link are substantially the same. In the embodiment, the antenna is a microstrip antenna. In the embodiment, the half magnetic loop structure is in a first plane and the ground plane structure is in a second plane parallel to the first plane. In the embodiment, the half magnetic loop structure is in a first plane and the ground plane structure is in a second plane perpendicular to the first plane. In the embodiment, the near-field zone extends a first distance from the half dipole and the ground extends a second distance from the half dipole, wherein the second distance is larger than the first distance.

The various features and processes described above may be used independently of one another, or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exorcized from the combination, and the claimed combination may be directed to a subcombination or a variation of a subcombination.

What is claimed:

1. A compound loop antenna, comprising:

a magnetic loop structure having a first end and a second end formed by an opening between the first end and the second end, the first end being connected to a feed and the second end being connected to a ground, the magnetic loop structure having a loop length defined by an electrical length of the magnetic loop structure;

a dipole positioned inside the magnetic loop structure, the dipole having a first arm and a second arm;

a first electrical link between the first arm and the magnetic loop structure creating a 90 degree phase delay from the feed along the electrical length of the magnetic loop structure; and a second electrical link between the second arm and the magnetic loop structure creating a 270 degree phase delay from the feed along the electrical length of the magnetic loop structure;

wherein the compound loop antenna is symmetric about an axis that passes through the opening between the first end and the second end.

2. The antenna of claim 1, wherein the first arm has a first electrical length and the second arm has a second electrical length and each of the first electrical length and the second electrical length is approximately one-quarter of the electrical length of the magnetic loop structure.

3. The antenna of claim 1, wherein the first electrical link has a first electrical length and the second electrical link has a second electrical length and each of the first electrical length and the second electrical length is approximately one-quarter of the electrical length of the magnetic loop structure.

4. The antenna of claim 1, wherein:

the first arm having a first inner end and a first outer end and the second arm having a second inner end and a second outer end, wherein the first inner end and the second inner end are positioned closer to a center point within the magnetic loop structure;

the first electrical link connects the first inner end to the first end of the magnetic loop structure; and the second electrical link connects the second inner end to the second end of the magnetic loop structure.

5. The antenna of claim 4, wherein: the first electrical link has a first electrical length and the second electrical link has a second electrical length, each of the first electrical length and the second electrical length being approximately one-quarter of the electrical length the magnetic loop structure.

6. The antenna of claim 1, wherein the first electrical link has a first straight edge and the second electrical link has a second straight edge substantially parallel to the first straight edge, wherein the first straight edge and the second straight edge are substantially parallel the axis.

7. The antenna of claim 1, wherein a width of the magnetic loop, a width of the first arm, a width of the second arm, a width of the first electrical link, and a width of the second electrical link are substantially the same.

8. The antenna of claim 1, wherein the antenna is a microstrip antenna.

9. A compound loop antenna, comprising:

a half magnetic loop structure having a first end connected to a feed and a second end connected a ground plane structure, the half magnetic loop structure having a loop length defined by an electrical length of the half magnetic loop structure;

a half dipole positioned inside the half magnetic loop structure, the dipole having an arm;

an electrical link between the arm and the half magnetic loop structure creating a 90 degree phase delay from the feed along the electrical length of the half magnetic loop structure; and wherein the ground plane structure is configured to have a size that extends beyond a near-field zone of the compound loop antenna so as to create a reflective equivalent of the half magnetic loop structure, the half dipole, and the arm.

10. The antenna of claim 9, wherein an electrical length of the arm is approximately one-quarter of the electrical length of the half magnetic loop structure.

11. The antenna of claim 9, wherein an electrical length of the electrical link is approximately one-quarter of the electrical length of the half magnetic loop structure.

12. The antenna of claim 9, wherein:

the arm has an inner end and an outer end, wherein the inner end is positioned closer to a center point between the first end and the second end of the half magnetic loop structure; and the electrical link connects the inner end of the arm to the first end of the half magnetic loop structure.

13. The antenna of claim 12, wherein: the electrical length of the electrical link is approximately one-quarter of the electrical length of the half magnetic loop structure.

14. The antenna of claim 12, wherein the electrical link has a substantially straight edge between the inner end and the outer end of the arm, and wherein the substantially straight edge is substantially parallel to at least a portion of an end of the ground plane structure.

15. The antenna of claim 9, wherein a width of the magnetic loop, a width of the arm, and a width of the electrical link are substantially the same.

16. The antenna of claim 9, wherein the antenna is a microstrip antenna.

17. The antenna of claim 9, wherein the half magnetic loop structure is in a first plane and the ground plane structure is in a second plane parallel to the first plane.

18. The antenna of claim 9, wherein the half magnetic loop structure is in a first plane and the ground plane structure is in a second plane perpendicular to the first plane.

19. The antenna of claim 9, wherein the near-field zone extends a first distance from the half dipole and the ground extends a second distance from the half dipole, wherein the second distance is larger than the first distance.

* * * * *